US009533307B2

(12) United States Patent
Beator et al.

(10) Patent No.: US 9,533,307 B2
(45) Date of Patent: Jan. 3, 2017

(54) SYSTEM FOR THE STABILIZATION, CONSERVATION AND STORAGE OF NUCLEIC ACID

(75) Inventors: Jens Beator, Berlin (DE); Norbert Wendt, Berlin (DE); Birgit Hoeding, Berlin (DE); Hans Joos, Berlin (DE)

(73) Assignee: STRATEC BIOMEDICAL AG, Birkfenfeld (DE)

( * ) Notice: Subject to any disclaimer, the term of this patent is extended or adjusted under 35 U.S.C. 154(b) by 427 days.

(21) Appl. No.: 13/554,755

(22) Filed: Jul. 20, 2012

(65) Prior Publication Data

US 2013/0019572 A1 Jan. 24, 2013

(30) Foreign Application Priority Data

Jul. 20, 2011 (DE) ..... 10 2011 051 997
Oct. 13, 2011 (DE) ..... 10 2011 054 474

(51) Int. Cl.
*B01L 3/14* (2006.01)
*B01L 3/00* (2006.01)

(52) U.S. Cl.
CPC ..... *B01L 3/5082* (2013.01); *B01L 3/50825* (2013.01); *B01L 3/5635* (2013.01); *B01L 2200/0642* (2013.01); *B01L 2200/141* (2013.01); *B01L 2300/044* (2013.01); *B01L 2300/047* (2013.01); *B01L 2300/0867* (2013.01)

(58) Field of Classification Search
CPC ..... A61B 5/14; B01L 3/50; B01L 2200/141; B01L 2200/023
See application file for complete search history.

(56) References Cited

U.S. PATENT DOCUMENTS

| | | | | |
|---|---|---|---|---|
| 5,538,870 | A | 7/1996 | Noeth et al. | |
| 6,027,945 | A | 2/2000 | Smith et al. | |
| 6,699,987 | B2 | 3/2004 | Hillebrand et al. | |
| 8,852,122 | B2 * | 10/2014 | Mao et al. | 600/572 |
| 2010/0255524 | A1 | 10/2010 | Hollaender | |
| 2011/0092687 | A1 | 4/2011 | Bendzko et al. | |
| 2011/0212002 | A1 * | 9/2011 | Curry et al. | 422/430 |
| 2012/0077283 | A1 * | 3/2012 | Durin | C12N 15/10 436/174 |

FOREIGN PATENT DOCUMENTS

| | | | |
|---|---|---|---|
| DE | 102007025277 | A1 | 12/2008 |
| WO | 0034463 | A1 | 6/2000 |

* cited by examiner

*Primary Examiner* — Jyoti Nagpaul
(74) *Attorney, Agent, or Firm* — Joyce von Natzmer; Agris & von Natzmer LLP

(57) ABSTRACT

Described is a system for the stabilization, conservation and storage of a nucleic acid, wherein the system comprises a test tube and a preferably freeze-dried stabilization mixture. Upon addition of a viscous bodily fluid to the mixture, the mixture dissolves and stabilizes the nucleic acid present in the bodily fluid.

20 Claims, 8 Drawing Sheets

A

B

SYSTEM FOR THE STABILIZATION, CONSERVATION AND STORAGE OF NUCLEIC ACID

CROSS REFERENCE TO RELATED APPLICATIONS

This application claims priority to German Patent application no. DE 10 2011 051 997.1, filed Jul. 20, 2011 as well as German Patent application no. DE 10 2011 054 474.7, filed Oct. 13, 2011, which are incorporated herein by reference in their entirety.

FIELD OF THE INVENTION

The invention relates to systems for the stabilization, conservation and storage of a nucleic acid. The system preferably comprises a test tube and a stabilization mixture which preferably dissolves in a viscous bodily fluid. Moreover, the invention relates to a method for stabilizing, conserving and storing of in particular nucleic acid, and to a kit.

BACKGROUND OF THE INVENTION

The analysis of the genome, proteome and/or methylome plays an ever-increasing role in many biological disciplines and is generally recognized as being superior to conventional methods such as, for example, the detection of metabolic products. These so-called molecular-biological analyses include, for example, medical and clinical diagnosis, forensics, the development and evaluation of drugs, foodstuff analysis, the cultivation of useful plants and environmental analysis.

Moreover, the analyses of the genome using methods such as, for example, PCR, RFLP, AFLP or sequencing, enable, for example, the detection of genetic defects or the determination of the HLA type as well as other genetic markers. Infectious pathogens such as viruses, bacteria, etc. can also be detected in this manner. The analysis of the methylome allows one to make statements about the activity of certain genes; certain methylation patterns, for example, point to the predisposition for certain diseases.

The polymerase chain reaction (PCR) is one of the most important biochemical methods for the amplification of nucleic acids. Using this technique, nucleic acids can be amplified very quickly and effectively and can then be sequenced or detected. One important field of application of PCR is clinical diagnosis.

However, in order to perform a comprehensive analysis, it is indispensable that a stable biological specimen is available so that the characteristics of the specimen are conserved. Particularly in the area of medicine, the stabilization of nucleic acids has a high priority. Specimens containing nucleic acid that are taken can frequently only be studied further after extended storage and, in some cases, transport to a laboratory. In the meantime, the nucleic acids in the specimens can change or even decompose completely. This has a massive impact on the result of tests performed later or even makes them impossible. Similarly unfavorable conditions can be found in forensics, for example, or in sampling under field conditions.

Stabilization, for example when using a stabilizing agent, should be associated with very simple and quick handling since, on the one hand, any necessary pretreatment of the specimen (e.g., washing or homogenization) prevents the immediate stabilization of the gene expression profile since, for example, RNA decomposes or is newly synthesized during the delay as a result of the pretreatment. On the other hand, any pretreatment and any additional processing step makes the use of the stabilizing agent difficult. Utilization anywhere where biological specimens are obtained, such as, for example, in the operating room, in field studies, in a food-producing business, at a crime scene, and the like is only conceivable/practical if handling is very simple and preferably does not involve the use a specific device and does not involve additional preparation of the specimen.

The purification of nucleic acids on solid phases that are based on a silica matrix is a technique used in many commercial kits. The principle of purification is based on the binding of the nucleic acids to the solid phase depending on the pH value and on the salt concentration of the buffer. Under chaotropic conditions, the network of hydrogen bridge relationships in the water is disturbed. As a result, the formation of a hydration shell around the macromolecule (DNA, RNA) is eliminated. In the absence of the chaotropic ions, a hydration shell forms again, so that the interaction between silica membrane and macromolecule is eliminated. Technically, this type of purification has been implemented e.g., in the spin-filter method and in magnetic beads technology.

The patents and patent publications referenced herein are incorporated herein by reference in their entirety.

For example, nucleic acid extraction is disclosed in U.S. Pat. No. 5,538,870. The extraction occurs basically in four steps: Cell lysis, binding of the nucleic acids to a matrix, and washing and elution of the nucleic acids. A drawback here is that the extraction is very time-consuming since, for example, numerous washing steps have to be carried out during which nucleic acid is always washed out as well. Consequently, the nucleic acid yield is reduced considerably. Furthermore, this extraction method is very difficult to automate.

Another variant of the isolation of nucleic acids using a silica matrix is disclosed, for example, in U.S. Pat. No. 6,027,945, in which magnetic silica particles are used. Molecules with a large surface are used which possess a magnetic moment when exposed to a magnetic field. Porous glasses, the surface of which has been modified with colloidal magnetite ($Fe_3O_4$) are used, among other things. These magnetic beads and a special binding buffer are added to the specimen after lysis. The nucleic acids bind to the silica matrix. Through the application of a magnetic field, the beads collect at the edge of the vessel and the impurities can be removed in several washing steps. Through the removal of the magnet and the addition of the elution buffer, the target molecules are dissolved. If a magnetic field is applied again, the elution buffer with nucleic acids can be separated from the beads. The advantage of this technique consists in the high degree to which the work sequences can be automated with low equipment costs.

U.S. Pat. No. 6,699,987 describes a kit and method for isolating nucleic acids which involves a binding to a solid phase/substrate via a lysis/binding buffer system which comprises at least one antichaotropic salt component. The antichaotropic salt component allows the nucleic acid to bind to solid phases such as glass fiber mats, glass membranes, silica carriers, ceramics, zeolites just like chaotropic materials.

A method for the stabilization of biological specimens is described, for example, in US Patent publication No. 20100255524. A biological specimen is brought in contact with a substance and stabilized by it.

Moreover, US Patent publication No. 2011092687 describes a stable lysis buffer mixture for the extraction of nucleic acids involving a storage-stable solid including controls and enzymes. The lysis buffer can be used simply for the lysis of nucleic acid-containing specimens in preparation for the purification of nucleic acids, but it can also be used for the purification itself.

Furthermore, the prior art describes means, e.g., containers, for receiving biological substances. A liquid buffer that stabilizes the nucleic acid present in a specimen over a short period of time can be introduced into these containers. In this context, liquid buffers are generally used for the stabilization via a closable cover on the funnel. Experience shows that this arrangement leads to errors during sampling, since the covers often close imprecisely and losses can occur.

Drawbacks of such systems include that they only allow storage over a short period of time (hours to days) and/or that the systems use liquid buffers. This generally results in a risk of contamination or of specimen loss.

There is a need in the art for a system with which a nucleic acid can be stored over an extended period of time, and in particular for a system that mitigates at least some of the drawbacks and shortcomings of the systems described in the prior art.

SUMMARY OF THE INVENTION

The present invention addresses these needs or aspects thereof as well as other needs in the art. Surprisingly the present system for the stabilization, conservation and/or storage of nucleic acids does in fact lack or mitigate some drawbacks and shortcomings of the prior art. The invention is, in one embodiment directed to a system that comprises a test tube as well as a preferably cover-free (open), more preferably a closing element-free funnel. The test tube has an opening which may be closed with a first closing element to create an interior. The funnel generally comprises an open conical element and a tube element. The tube element may be fitted to the opening of the test tube. A liquid containing the nucleic acid may be introduced into the test tube via the funnel that is, e.g., inserted into the tube and the tube is then preferably closed and/or sealed with another, preferably second closing element after the liquid is introduced. The first closing element can, for example, be a cover (screwable or pluggable), stopper or seal, wherein the seal might comprise or consist of a plastic and/or metal layer. The second closing element generally sealably fits the opening of the test tube. The closing element, in particular the first closing element, can, in one embodiment, be removed easily and quickly from the tube by a user and also may indicate to the user that the tube is intact. In this way, it can be ensured that the tube is free of contaminations. The test tube may be a standard test tube holding a volume of 1 to 20 ml. The opening of the test tube may be sealed.

Thus, in a preferred embodiment, the interior of the test tube closed with a first closing element is sterile, which means in the present context that it is free of nucleic acid including nucleic acid containing substances such as bacteria and viruses. In a preferred embodiment the closing element is pierceable, in particular by the end of a funnel that has the shape of a tube, ergo the tube element. Using a pierceable closing element and/or a cover-free (open) funnel ensures that the user, after the introduction of the nucleic acid, closes the tube with another, separate closing element rather than the funnel.

Suitable for use as the other, particularly second closing element, is a screwable or pluggable cover which is, for example, used to close the tube after the introduction of the specimen and removal of the funnel. However, it can also be preferred that the first closing element is used as the second closing element if it is free of contamination and reusable. For example, this may be the case with a screwable cover or a stopper, but not with a seal in the form of a plastic and/or metal layer.

The invention is also directed at a method for stabilizing, conserving and/or storing nucleic acids comprising: providing any one of the systems disclosed herein and introducing a fluid containing a nucleic acid via the funnel into the test tube. The stabilizing, conserving and/or storing of the nucleic acids may last at least 5 days, 2 weeks, at least about one month or at least about 2, 6, 9 or 12 months. The stabilizing, conserving and/or storing may occur at room temperature/15-30° C. After storing the nucleic acid in the test tube with the stabilization mixture for 2, 3, 4, 5, 6, 7, 8, 9, 10, 11 or 12 months, at a storage temperature between 15 and 30 degrees, 70-80%, preferably 80-90% or 90% to 100% of the nucleic acid may be intact (see figures) and may be analyzed.

It may be preferred that a stabilization mixture, in particular a solid, more in particular a freeze-dried stabilization mixture is present in the tube. In certain embodiments, it may be advantageous for the stabilization mixture to be a liquid that can be introduced into the tube. This can advantageously be a liquid buffer which is introduced into the tube before or after the introduction of the specimen. It came as a complete surprise that the liquid buffer mixes quickly with a viscous bodily fluid without the need for mechanical intervention. This results in a simple, portable (mobile) and universally applicable system.

The stabilization mixture may be a substance that dissolves in a viscous bodily fluid containing the nucleic acid. The nucleic acid may comprise DNA. The bodily fluid may be blood plasma, chyle, lymph, urine, sperm, vaginal secretion, amniotic fluid, sputum, gastric juice, bile, pancreatic juice, nasal secretion, bronchial secretion, alveolar fluid, liquor, endolymph, aqueous humor, lacrimal fluid, synovial fluid, pleural fluid, pericardial fluid (liquor pericardii), peritoneal fluid, mother's milk, sweat, menstruation fluid or a combination thereof.

The denaturant may be cetryltrimethylammonium bromide (CTAB), the chelator may be ethylenediamine-tetraacetic acid (EDTA) and the buffer may be tris(hydroxymethyl)aminomethane (TRIS). The stabilization mixture may also comprise ammonium chloride and/or polyvinylpyrrolidone and/or another polymer composed of vinyl monomers. CTAB may be present in a concentration of 1-4%. EDTA may be present in a concentration of 0.05-1%. TRIS may be present in a concentration of 0.05-1%. The ammonium chloride may be present in a concentration of 15-25%. The polyvinylpyrrolidone or other polymer composed of vinyl monomers may be present in a concentration of 1-4%. The stabilization mixture may comprise a reducing agent, an antiviral and/or an antimicrobial agent. At least said first closing element may be a closing element that can be removed from the test tube. The closing element may be made of a material that is pierceable, e.g., via the tube element of the funnel.

The invention is also directed at a method for stabilization, conservation and storage, comprising a test tube and a stabilization mixture present therein or to be introduced therein, wherein a. a first closing element of the tube is removed or pierced by a cover-free (open) funnel that is inserted into the tube, b. a viscous bodily fluid containing nucleic acid is filled into the test tube up to a mark on the test tube, c. (i) mixing of the contents by inverting the test tube several times, thus substantially dissolving a freeze-dried stabilization mixture present in the tube, or
(ii) addition of the stabilization mixture, particularly as a liquid buffer, to the tube and mixing of the contents by inverting the tube several times, d. closing of the test tube with a closing element, and e. storage of the test tube at 15-30° C. for up to 12 months and/or at least 1 week, two weeks, three weeks, at least one, two, three, four, five or six months.

The invention is also directed at a kit for stabilizing, conserving and storing nucleic acids, comprising any of the systems disclosed herein or any components of any one of said systems and, optionally, in a separate container, instructions of how to use the components/the components of the system. The components of the kit might be contained in a container which might part of the kit/system. The container might be a blister, which allows the consumer to see the components of the kit. The container may be 10 to 30 cm long and 5 to 20 cm wide and weigh, including all components of the kit, not more than 1 kg or 500 g. The kit/system contains, in certain embodiments, multiple, preferably disposable funnels and/or multiple disposable test tubes.

In a preferred embodiment, the invention is directed at a system for the stabilization, conservation and storage of nucleic acids, comprising a test tube and a stabilization mixture, wherein the mixture is present in the test tube in a freeze-dried state.

Not only is the system stable (storage-stable) for a long period of time, but it stabilizes the nucleic acid introduced into the tube for a long period of time as well, preferably for (at least) 2 months, more preferably (at least) 6 months, especially preferably (at least) 9 months and very especially preferably 12 months.

The test tube is preferably a standard test tube, with an optional funnel for transferring the specimen and a closing element such as, for example, a cover or stopper for closing after transferring the specimen. Preferably, a standard test tube can be used, which particularly keeps the manufacturing costs and, consequently, the acquisition costs of the system low. A standard test tube may hold 1 ml to 20 ml of a fluid. Generally it comprises glass or plastic tubing, is open at the top, usually with a rounded U-shaped bottom. The system can be manufactured successfully using a mass production method. The test tube with the freeze-dried mixture can advantageously be stored at room temperature, preferably between 15° C. and 30° C., thus there are no high storage costs. More advantageously, the tube is readily usable, since it does not have to be brought to an appropriate reaction temperature. The liquid stabilization mixture can also be present in the tube before the introduction of the specimen. In this context, it was surprising that the liquid stabilization mixture is also storage-stable and can be stored over a long period of time at room temperature, e.g. for 12 or 24 months.

It may be preferable for other container to be used for the system as well. For instance, it can be advantageous, to use as test tubes within the meaning of the present invention, in particular vials, beakers, flasks, blood removal systems or other containers suitable for fluids.

DESCRIPTION OF VARIOUS AND PREFERRED EMBODIMENTS OF THE INVENTION

Figure 1:
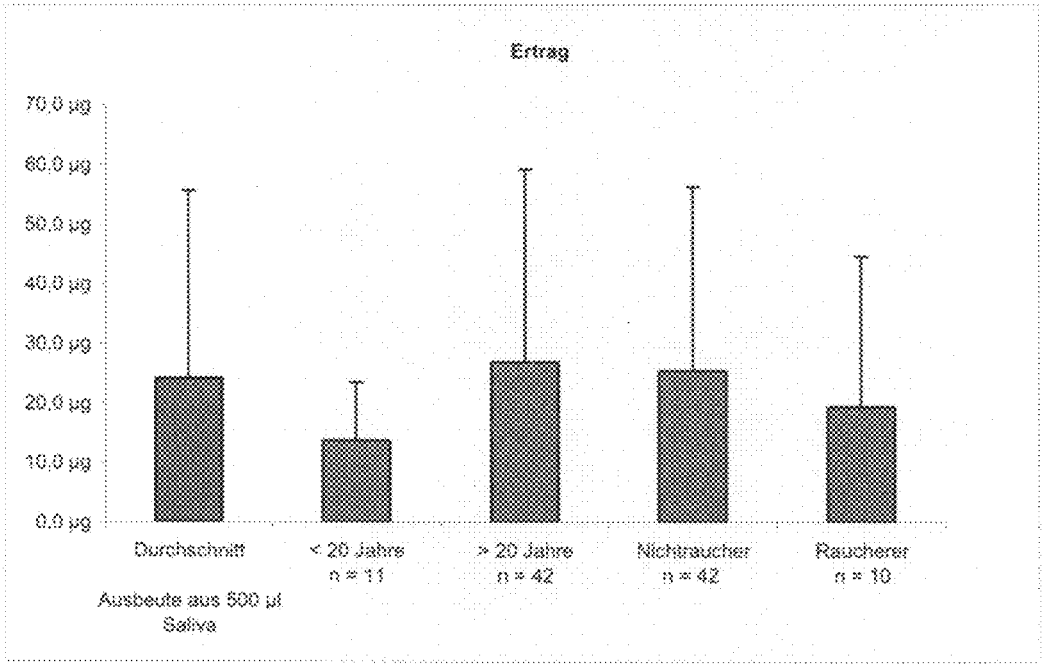
FIG. 1 shows the yield of an analysis using the preferred system.
Figure 2:
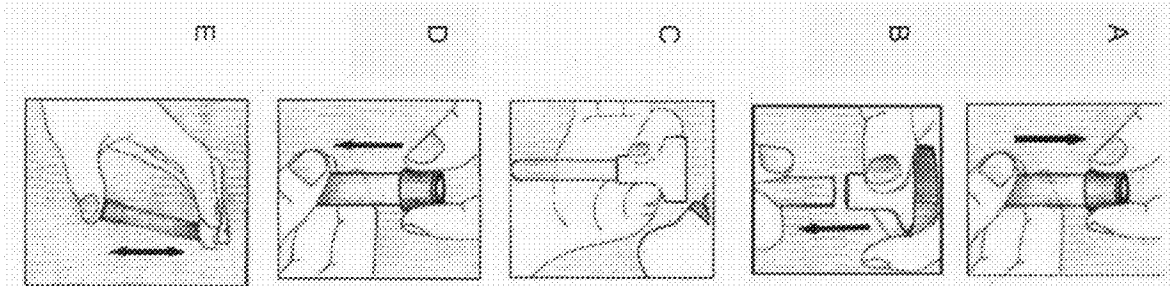
FIG. 2A-E shows a preferred method for filling the test tube.
Figure 3:
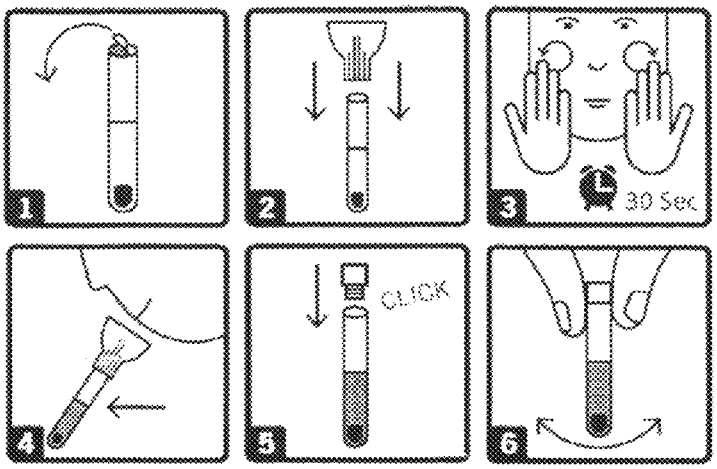
FIG. 3A, B shows the opening, filling and closing of the test tube.
Figure 3:
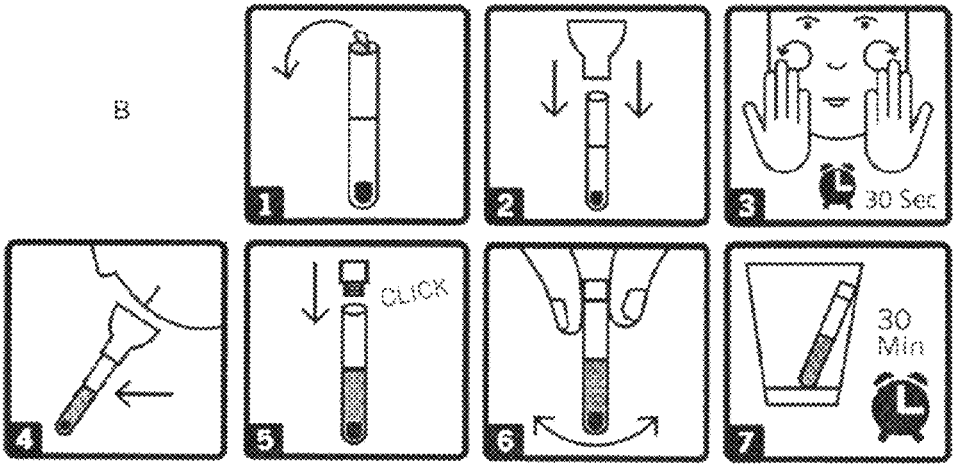

The invention can be referred to as a combination invention, since a storage-stable stabilization mixture which allows for extended storage, particularly a lysis and specimen stabilization mixture, is combined with a suitable sampling system. This makes it possible to store the nucleic acid of a specimen placed in the tube (e.g., a bodily fluid) over a long period of time, wherein the nucleic acid can surprisingly be stored at room temperature. Through the combination of the tube with the stabilization mixture synergistic effects occur which are advantageous in comparison to the systems described in the prior art.

While the prior art does describe storage-stable lysis systems or mixtures, no system comprising the sample (the bodily fluid or the nucleic acid contained therein) is described to be storage-stable. Advantageously, the mixture present in the tube is already storage-stable and can be stored over a long period of time, preferably between 1 to 24 months, including more than six months or more than one year, at room temperature. Moreover, the bodily fluid introduced into the system, or the nucleic acid contained therein, can also be stored stably at room temperature for a long period of time. Accordingly, the system can be used for the stabilization, conservation and storage of nucleic acids. Furthermore, the system for the stabilization, conservation and storage of nucleic acids can be used to store nucleic acids for more than 2 months, preferably more than 6 months, more preferably more than 9 months and particularly for more than or up to 12 months. The system for stabilization, conservation and storage is preferably used at room temperature.

It should be noted that the stabilization mixture can be used in conjunction with preservatives or even only as an additive in preservatives. The term "preservative" is understood particularly as referring to mono- or polyvalent alcohols, aromatic alcohols, salts and solutions thereof, cross-linked agents, cationic detergents and other reagents known to a person skilled in the art.

A person can introduce a bodily fluid into the tube, the bodily fluid may be blood plasma, chyle, lymph, urine, sperm, vaginal secretion, amniotic fluid, sputum, gastric juice, bile, pancreatic juice, nasal secretion, bronchial secretion, alveolar fluid, liquor, endolymph, aqueous humor, lacrimal fluid, synovial fluid, pleural fluid, pericardial fluid (liquor pericardii), peritoneal fluid, mother's milk, sweat, menstruation fluid or a combination thereof. It came as a complete surprise that the system is compatible with numerous bodily fluids and stabilizes the nucleic acid present in the bodily fluid. The system can therefore be used universally and does not require any elaborate modifications or additions prior to use. Accordingly, the system can be referred to as a "ready-to-use" system.

The bodily fluid contains nucleic acid and the nucleic acid preferably comprises DNA. A person skilled in the art knows that there are numerous different nucleic acids in a bodily fluid, and a nucleic acid in terms of the invention refers particularly to a macromolecule made up of individual components, the nucleotides. Particularly, nucleic acids comprises a simple sugar and phosphoric acid ester, a nucleobase being appended to each sugar. In a preferred embodiment, the system is used for the stabilization, conservation and storage of nucleic acid, particularly DNA.

According to the invention, DNA refers particularly to long-chain polynucleotides which contain the primary genetic information (the genome) of living things stored in them. In eukaryotes, the majority of the DNA is contained in the cell nucleus, specifically in the chromosomes or in the chromatin. In bacteria, it is not located in a separate cell organelle and usually consists of a single, closed, ring-shaped molecule. Besides the genomic DNA, bacteria also contain smaller, also ring-shaped DNA molecules: the easily transmissible plasmids. It came as a complete surprise that, using the system, DNA can be stabilized and stored easily and quickly at room temperature and no additional additives or treatments of the specimen are required. A simple-to-use system is therefore being provided with which a nucleic acid can be stabilized in a preferably viscous or, in particular, non-viscous bodily fluid and stored and conserved at room temperature. The nucleic acid, particularly the DNA, is substantially unharmed and can therefore passed on as a whole for subsequent analysis. This represents a considerable advantage compared to the prior art, since damaged nucleic acid only allows for an incomplete analysis. Using the system, the comprehensive analyses can therefore be performed with the nucleic acid following storage.

The stabilization mixture, which is preferably present in the test tube in a freeze-dried state or can be introduced therein as a liquid and serves to stabilize the nucleic acid, preferably comprises a denaturant, a chelator and a buffer.

Freeze-drying, which can also be referred to as lyophilization or sublimation drying, is a method for the gentle drying of valuable products. In freeze-drying, the ice crystals sublimate directly without transitioning into the liquid state. The final product of freeze-drying is called lyophilizate.

The stabilization mixture is preferably a substance dissolving in the viscous bodily fluid containing the nucleic acid which is being introduced into the test tube. That is, the stabilization mixture is preferably in a freeze-dried state in the test tube and preferably dissolves in a viscous bodily fluid or is binding same. It came as a complete surprise that no emulsion, but rather an optimally mixed liquid forms by mixing the viscous bodily fluid and the stabilization mixture. No mixture that dissolves in a viscous bodily fluid is described in the prior art that stabilizes a nucleic acid. Moreover, the volume of the mixture always needs to be adapted to the quantity of specimen to be stabilized, which is not necessary in the preferred systems. The system thus enables flexible and easy use.

The stabilization mixture preferably comprises a denaturant. In terms of the invention, a denaturant is particularly a chemical substance which brings about a structural change in biomolecules. It is preferred that the denaturing be triggered by chemical influences, i.e., by a chemical substance, although it can also be advantageous if the stabilization mixture does not contain a denaturant and denaturing occurs due to heat or high-energy radiation. The chemical substance that is preferably present in the stabilization mixture is preferably an acid, base, salt, detergent, guanidine or a combination thereof. In an especially preferred embodiment, the denaturant is cetryltrimethylammonium bromide (CTAB), which is preferably present in a concentration of 1-4%.

CTAB is a quaternary ammonium compound with a long-chain alkyl group and a cationic surfactant. Particularly, it forms insoluble complex compounds with nucleic acids. Preferably, CTAB solutions at room temperature are stable for several years. However, it can also be advantageous to use other ammonium compounds, preferably benzalkonium chloride, cetylpyridinium chloride, denatonium benzoate, TBAH or paraquat instead of or in addition to CTAB.

Moreover, the stabilization mixture comprises a chelator, preferably ethylenediamine-tetraacetic acid (EDTA), which is preferably present in a concentration of 0.05-1%. EDTA is a hexadentate complexing agent. Both nitrogen atoms are able to attach to a central ion with their free electron pairs, as are the four carboxy groups, each with an oxygen atom. This ligand therefore forms especially stable complexes. It came as a complete surprise that, instead of EDTA or in addition thereto, nitrilotriacetic acid (NTA), ethylene glycol-bis(aminoethyl ether)-N—N'-tetracetic acid (EGTA), ethylenediaminedisuccinic acid (EDDS), citric acid, polycarboxylates or phosphonates can also be used in the stabilization mixture.

Furthermore, the stabilization mixture comprises preferably the buffer tris(hydroxymethyl)aminomethane (TRIS), which is preferably present in a concentration of 0.05-1%. TRIS describes a primary amine with three alcoholic hydroxy groups. It came as a complete surprise that the combination of TRIS, CTAB and EDTA form a stabilization mixture that enables stabilization, conservation and storage of a nucleic acid wherein the mixture dissolves in a viscous bodily fluid or binds thereto.

It may also be preferred for the stabilization mixture to comprise triton, preferably triton X-15, X-35, X-45, X-100, X-102, X-104, X-114, X-165, X-305, X-405 and/or X-705. Triton is a nonionic surfactant from the group of the octylphenolethoxylates which denatures proteins. Surfactants are amphiphile (bifunctional) compounds with at least one hydrophobic and one hydrophilic molecule. The hydrophobic group is usually a preferably linear hydrocarbon chain with preferably 8 to 22 carbon atoms. The hydrophilic group is either a negatively or positively electrically charged (hydratable) or a neutral polar headgroup. Surface-active betaines or amino acid surfactants (amphoteric or zwitterionic surfactants) carry negatively and positively charged groups in a molecule. Advantageous characteristics of surfactants are targeted adsorption on boundary surfaces and the aggregation of micelles and the formation of lyotropic phases. Nonionic surfactants have an uncharged headgroup that makes substances water-soluble.

It came as a complete surprise that the stabilization performance is improved significantly as a result of the stabilization mixture to which triton has been added. Moreover, the purified nucleic acid has a high level of purity, i.e., it contains essentially no other components. The purity of the nucleic acid plays an important role particularly in other analytic methods, since numerous enzymes such as, for example, DNA polymerase, are functionally impaired by impurities. This can lead to incorrect results.

A person skilled in the art knows that the number and availability of biological specimens is often limited and every specimen must be used with caution. Accordingly, the preferred system can be regarded as a technical advancement, since the nucleic acid is not damaged during stabilization as well as conservation and storage and therefore constitutes an optimal starting material for subsequent analyses.

In another preferred embodiment, the stabilization mixture comprises ammonium chloride and/or polyvinylpyrrolidone, with ammonium chloride being present in a preferred concentration of 15-25% and polyvinylpyrrolidone in a preferred concentration of 1-4%. Ammonium chloride is the ammonium salt of hydrochloric acid. According to the invention, polyvinylpyrrolidone (PVP) particularly refers to a crosslinked polymer that is substantially insoluble in water and all solvents. PVP is advantageously a polymer is made up of vinyl monomers. Instead of PVP, or in combination with PVP, it may be preferred to use another polymer composed of vinyl monomers for a preferred system. A polymer composed of vinyl monomers preferably has the following formula:

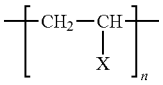

Here, X refers to a heteroatom or a group fixed via a heteroatom. The preferred groups are shown in the following table:

TABLE 1

| X | Name |
|---|---|
| —OH | Polyvinyl alcohol (from polyvinyl acetate) |
| -halogen | Polyvinyl chloride, polyvinyl fluoride, etc. |
| —O—CO-R | Polyvinyl ester |
| 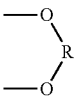 | Polyvinyl acetate |
| —O-R- | Polyvinyl ether |
| —P(O)(OH)$_2$ | Polyvinylphosphonic acids |
| —C$_6$H$_5$ | Polystyrene |
| —SO$_3$H | Polyvinyl sulfonic acids |
| —NH$_2$ | Polyvinylamine |
| 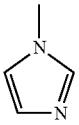 | Polyimidazole |
| 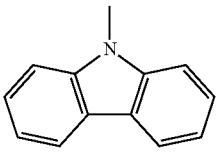 | Polyvinylcarbazole |

TABLE 1-continued

| X | Name |
|---|---|
| 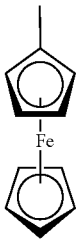 | Polyvinylferrocene |

In a preferred embodiment, the stabilization mixture comprises a reducing agent, an antiviral and/or an antimicrobial agent. According to the invention, a reducing agent is particularly a substance that gives off electrons and can therefore reduce other substances while oxidizing itself (electron donor). Reducing agents comprise, among others, lithium aluminum hydride, sodium borohydride, sodium sulfite, sodium dithionite, sodium thiosulfate, hydrazine, sodium hydride, lithium, sodium, potassium or zinc. According to the invention, an antiviral agent particularly describes an agent that acts against viruses and inhibits the reproduction of virus particles in the infected body. Antiviral substances often interfere with enzymatic processes that are necessary for the virus particle to reproduce and, at the same time, are specific for the virus in question. For example, after being converted to the corresponding 5'-phosphate, the nucleoside analog azidothymidone has a greater affinity to the reverse transcriptase of retroviruses and clearly inhibits this virus-specific enzyme more strongly than the body's own DNA polymerases. Another mechanism of action of antiviral substances includes preventing the attachment and penetration of the virus particles into the cell (e.g., through the tricyclic amine amantadine, which acts against influenza viruses). Moreover, the maturation of new virus particles or the exportation thereof can be prevented so that no other cells can be infected and the infection cannot spread any further (e.g., neuraminidase inhibitors). What is more, an antimicrobial agent can be added to the stabilization mixture. In terms of the invention, an antimicrobial agent particularly describes an agent that acts against bacteria and the reproduction thereof. The best-known representatives of this group are the antibiotics. It came as a complete surprise that the addition of a reducing agent, an antiviral and/or an antimicrobial agent contributes to the improvement of the purity of the nucleic acid to be stabilized, thus improving the accuracy of measurement and the analysis of the nucleic acid considerably.

Advantageously, the tube is closed to keep out contamination and air humidity, so high standards of sterility are met. It is preferred for the tube to be closed with a closing element, such as a cover or a stopper. This can be reused after opening of the tube and thus protects the specimen transferred to the tube from contamination.

The invention also relates to a method for the stabilization, conservation and storage of nucleic acids, comprising a test tube and a stabilization mixture present therein or to be introduced therein, wherein a. an element closing the tube is removed or pierced by a cover-free funnel that can be inserted into the tube, b. a viscous bodily fluid containing nucleic acid is filled into the test tube up to a mark on the test tube, c. (i) mixing of the contents by inverting the test tube several times, thus substantially dissolving a freeze-dried stabilization mixture present in the tube, or
(ii) addition of the stabilization mixture, particularly as a liquid buffer, to the tube and mixing of the contents by inverting the tube several times, d. closing of the test tube with a second closing element, and e. storage of the test tube at 15-30° C. for up to 12 months.

The stabilization mixture can be present in the test tube in a freeze-dried state or be introduced into the tube as a liquid before or after the introduction of the specimen. The test tube is a standard container with a volume of 1 ml to 20 ml. To fill the test tube, a person removes the closing element or pierces it with the funnel that can be inserted into the tube. The closing element can therefore be embodied as a cover or stopper or as a layer applied to the tube.

The closing element is preferably sealed so that it is clear that the test tube is used for the first time and has not previously been used. The bodily fluid can be introduced by the person into the tube via the funnel, after which the person removes the funnel and closes the tube with the first closing element or another closing element. So that the person knows how much bodily fluid must be introduced into the tube by volume, the tube has a mark up to which the tube is to be filled. The freeze-dried stabilization mixture present in the test tube is dissolved by the viscous bodily fluid, wherein this combination of bodily fluid and stabilization mixture preferably results in a buffer which stabilizes the nucleic acid. The liquid stabilization mixture introduced into the tube binds to the bodily fluid, thus also stabilizing the nucleic acid. As a result, the stabilization, conservation and storage of the nucleic acid is possible at room temperature over a long period of time, preferably more than 2 months, more preferably more than 6 months, especially preferably more than 9 months and particularly more than or up to 12 months.

If, in the context of the present invention, one element is said to be "fitted to" the other, it means that the two elements can be removably connected to each other, wherein the connection established allows for a leakage free transfer of media, e.g., liquids. For example, if the tube element of a funnel is fitted to an opening of a test tube, it can be either readily inserted into the test tube or put over the exterior of the test tube, wherein the inner diameter of the tube element of the funnel corresponds to the outer diameter of the test tube in so far as that there is no leakage when, e.g., a liquid is filled via the funnel into the test tube.

If a closing element is said to "sealably fit" an opening, e.g., the opening of a test tube, the closing element has a shape that allows one to close said opening with the closing element.

The method thus enables the easy and cost-effective stabilization, conservation and storage of nucleic acids, which can be analyzed subsequently. A genomic, transcriptomic or methylomic analysis can be provided during the analysis of biomolecules. The molecular biological methods respectively used for this, particularly amplification, sequencing and detection techniques, are known to a person skilled in the art from the relevant literature and are easy to find.

The analysis can be performed in situ or ex situ, e.g., after the isolation of the biomolecules, particularly of the nucleic acid. It can therefore be expedient for the specimen to by lysed or homogenized for the purpose of the analysis. This can be done mechanically, for example by means of cannulas, mortars, rotor/stator homogenizer, a conical grinder or the like, by chemical means through the use of suitable lysis buffers which usually contain determents and/or chaotropic or non-chaotropic substances, by enzymatic means, for example using proteases, or through a combination of these measures.

It may also be preferred that the nucleic acid also comprise RNA in addition to DNA and the system for the stabilization, conservation and storage of nucleic acids, preferably DNA and/or RNA, be used. RNA refers to an elongated molecule that primarily has the function in the cell of converting the genetic information stored in the deoxyribonucleic acid (DNA). Various forms of RNA are involved in this: mRNA, which provides information on protein biosynthesis (translation) as a copy of the genes, rRNA, which is represented in the ribosomes in the form of various species (5S, 16S, 23S in bacteria and 5S, 8S, 18S, 28S in higher organisms), and tRNA, which mediates the embedding of the activated amino acids into the growing protein chain on the ribosomes. In addition, the cell nucleus contains the heterogeneous nuclear RNA (hnRNA) comprises precursors of mRNA, as well as the small nuclear RNA (snRNA) involved in the joining of exons of RNA. RNA molecules can also possess enzymatic activities (ribozymes) or take over regulatory function through RNA interference (siRNA, miRNA). Such RNAs are frequently grouped together under the term ncRNA. In RNA viruses, the RNA itself is the carrier of the genetic information. It came as a complete surprise that, using the system, DNA is stabilized in a preferably viscous bodily fluid over a long period of time, preferably at least 12 months. Moreover, it was surprising that, in addition to the stabilization of DNA, the stabilization of RNA, including mRNA, tRNA, rRNA, snRNA, miRNA, virus RNA or hn RNA DNA is possible using the system. Consequently, both forms of nucleic acid can be stabilized for subsequent analysis with the aid of the system. It came as a complete surprise in this respect that nearly 70-80%, preferably 80-90% and very especially preferably 90-100% of the nucleic acid present in the bodily fluid is intact and available for analysis.

The invention further relates to a kit for the stabilization, conservation and storage of nucleic acids, comprising a system, a closing element for the test tube and a funnel that can be inserted into same. The kit is universally applicable, mobile and enables the quick stabilization of a nucleic acid present in a bodily fluid. The kit/system comprises a cover-free funnel for filling the tube, the funnel being disposable after filling, since the tube can be closed with a separate closing element (e.g., a cover). A stabilization mixture for the stabilization of the nucleic acid present in the bodily fluid can be present in the tube as a freeze-dried mixture or be filled into the tube as a liquid mixture, and this can be done before or after the addition of the specimen.

The invention entails numerous advantages, including:

more nucleic acid can be extracted, since it does not bind to a matrix in one embodiment and nucleic acid is hence not lost through incomplete binding;

no discrimination between various components of the specimen;

simple and quick execution with reduced number of work steps;

automation possible;

depending on the vessel, very large quantities of specimen can also be stabilized.

In certain embodiments, the invention combines element such as a test tube with a preferably freeze-dried or liquid stabilization mixture, which leads to surprising effects in the stabilization of nucleic acids. For instance, it came as a complete surprise that the freeze-dried or liquid mixture dissolves essentially completely in a viscous bodily fluid, thus making available a buffer system that enables the stable storage and conservation of nucleic acid at room temperature. It is completely foreign to a person skilled in the art that a freeze-dried or liquid mixture can be dissolved in a viscous fluid without mechanical intervention by stirring, for example. This is particularly advantageous for the mobile application of the system and enables immediate use of the system. Only the combination of compounds leads to synergistic advantages which bring about the efficient stabilization, conservation and storage of nucleic acids.

Further advantages of the systems are:

a) The stabilization mixture is storage-stable.
b) The mixture for the stabilization of nucleic acid is used and dissolves substantially in a viscous bodily fluid, thus forming a buffer that stabilizes a nucleic acid.
c) The solid system (freeze-dried stabilization mixture) is much more secure than a liquid system, since it cannot run out.
d) The nucleic acid yield after storage is substantially without loss. In certain embodiments the loss constitutes not more than 1%, 5% or 10% after 2, 3, 4, 5 or 6 months.
e) The stabilization mixture can stabilize a variable quantity of nucleic acid, so different volumes of bodily fluid can be filled into the tube.

In the following, the invention is described on the basis of sample embodiments for the sake of example without being limited thereto.

EXAMPLES

While the below examples disclose specific embodiments of the present invention in which certain elements of the invention are disclosed in a specific context, it is noted that the invention includes the use of such elements in a different context.

Example 1

Prepare stabilization mixture

Freeze-dry stabilization mixture; only in this way is a consistency achieved that dissolves in a bodily fluid, for example sputum Place sputum into the test tube on the freeze-dried mixture Sputum dissolves freeze-dried mixture DNA is storage-stable at room temperature, preferably 15-30° C., particularly for 12 months.

DNA purification according to the prior art

FIG. 1 shows the yield of an analysis performed with a preferred system. Lysis stabilization mixture was prepared according to Example 1 and filled into a tube (e.g., 1.5 ml each). Freeze-drying was performed for 24 hours in appropriate equipment. After test subjects deposited sputum samples into the tubes, they were stabilized for 6 months and then isolated according to the following procedure:

500 μl stabilized specimen is laced with 20 μl proteinase K 30 mg/ml and incubated at 50° C. for 10 min. 200 μl binding buffer B6 (Stratec Molecular) is added. The mixture is placed onto a "spin filter" DNA binding filter (Stratec Molecular), followed by centrifugation at 10,000 g for 1 min. 500 μl wash buffer 1 (Stratec Molecular) is placed on the spin filter, followed by centrifugation at 10,000 g for 1 min. 600 μl wash buffer 2 (Stratec Molecular) is placed on the spin filter, followed by centrifugation at 10,000 g for 1 min. Then dry centrifugation is performed at 10,000 g for 5 min. 100 μl elution buffer (Stratec Molecular) is placed on the spin filter, followed by centrifugation at 10,000 g for 1 min. The throughput "eluate" contains the pure DNA.

The total DNA yields from 500 μl were determined and plotted based on age and lifestyle.

FIG. 2A-E and FIG. 3A, B show a preferred method for the opening, filling and closing/sealing of the test tube. Step 1—Preparation: The tube with the white solid, which represents the stabilization mixture, is removed from the packaging, at which time the solid should be located at the bottom of the tube. If the white solid is not on the bottom, one may tap the tube gently against a solid foundation until the solid is on the bottom again. The cover (A) is removed from the tube and kept. The funnel is placed on the test tube. Step 2—Sampling: In order to deposit a bodily fluid such as saliva, the tube is held with the funnel to the mouth and sputum is deposited until the amount of liquid sputum (not foam) reaches the fill level indicated on the test tube (upper arrow on the label). If the volume of sputum is too small, the cheekbones can be massaged, for example, in order to stimulate sputum production. Step 3—Stabilization: Removal of the cap. The tube is securely closed with the cover. The contents of the tube can be mixed by turning and shaking 10-15 times. The solid need not be dissolved completely in this context. Moreover, the tube can be incubated for a short time, e.g., 30 minutes, in order to improve the dissolution of the stabilization mixture. The specimen is now stable for at least 12 months at room temperature. The funnel can be disposed of.

Figure 4:
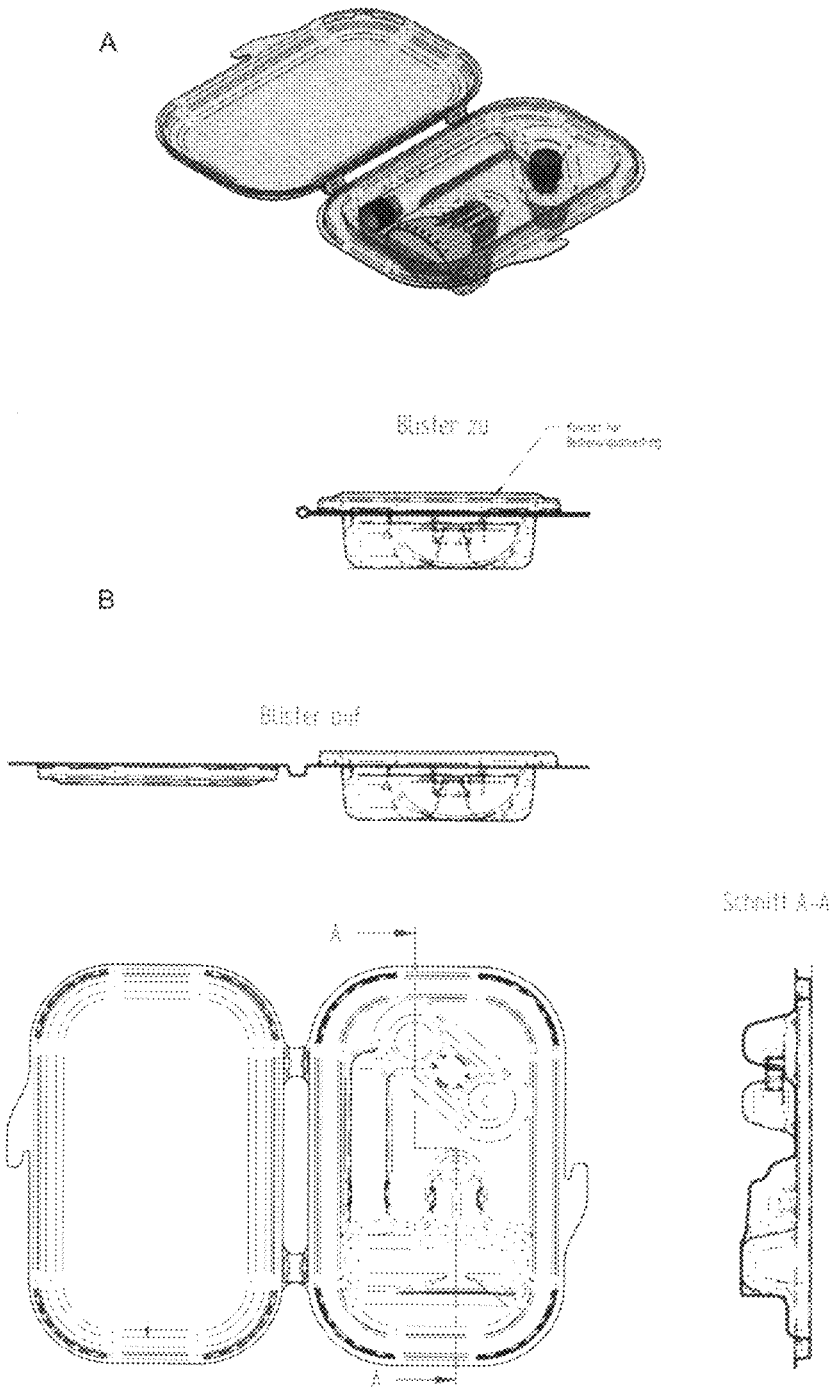
FIG. 4A, B shows a preferred kit.

FIG. 4A, B shows a preferred kit. The kit preferable has a test tube, a closing element and a funnel. The tube is preferably sealed in order to guarantee the first use. Moreover, the kit can contain instructions for using the tube, funnel and/or closing element. FIG. 4B shows different views of the kit. It can be seen that the kit is very small and compact and thus suitable for mobile use.

Example 2

Prepare stabilization mixture

Figure 5:
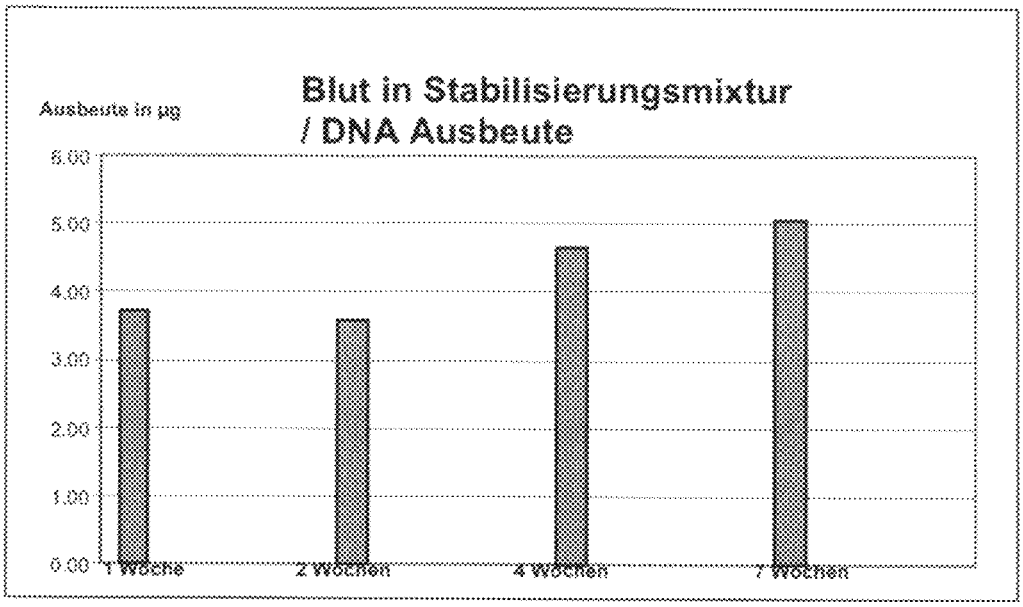
FIG. 5 shows the stabilization of DNA in blood.

Freeze-dry stabilization mixture; only in this way is a consistency achieved that dissolves in a bodily fluid, for example blood Place EDTA blood into the test tube on the freeze-dried mixture Blood dissolves freeze-dried mixture DNA is storage-stable at room temperature, preferably 15-30° C., particularly for 7 weeks DNA purification according to the prior art FIG. 5 shows the stabilization of DNA from blood. It is evident that, using the system, a high DNA concentration in blood can be stabilized, stored and conserved. The DNA can be isolated using the purification methods described in the prior art, wherein it is possible to stabilize the DNA with the system for a long period of time and to store and conserve it.

Figure 6:
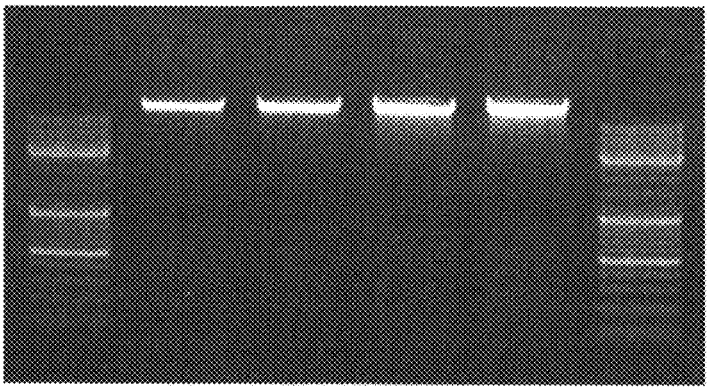
FIG. 6 shows a gel analysis of blood samples treated directly with the system without the storage of DNA after isolation.

FIG. 6 shows a gel analysis of blood samples treated directly with the system without storage after DNA isolation. The following specimens were applied to a 0.8% agarose gel: 4 specimens, 10 μl specimen and 3.5 μl DNA ladder (first and last lanes). It is evident that the DNA did not decompose, as the DNA shows a clean, distinct band.

Figure 7:
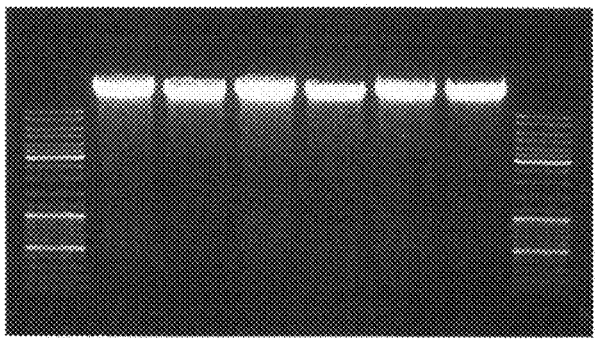
FIG. 7 shows gel analysis of isolated DNA after storage of the blood sample at room temperature for seven weeks.

FIG. 7 shows a gel analysis of isolated DNA after storage of the blood sample at room temperature for seven weeks. The following specimens were applied to 0.8% agarose gel: 6 specimens, 9 μl specimen and 3.5 μl Gene Ruler DNA Ladder Mix (first and last lanes), Fermentas. The DNA is not decomposed and shows a clean, distinct band. Even after a long period of stabilization, storage and conservation, the DNA is stable and exhibits no loss of integrity.

Example 3

Prepare tube with stabilization mixture
Place sputum in the test tube on the buffer
Mix the sputum with the buffer
DNA is storage-stable at room temperature, preferably 15-30° C., particularly for 12 months.
DNA purification according to the prior art 500 μl stabilized specimen is laced with 20 μl proteinase K 30 mg/ml and incubated at 50° C. for 10 min. 200 μl binding buffer B6 (Stratec Molecular) is added. The mixture is placed on a "spin filter" DNA binding filter (Stratec Molecular), followed by centrifugation at 10,000 g for 1 min. 500 μl wash buffer 1 (Stratec Molecular) is placed on the spin filter, followed by centrifugation at 10,000 g for 1 min. 600 μl wash buffer 2 (Stratec Molecular) is added to the spin filter, followed by centrifugation at 10,000 g for 1 min. 600 μl wash buffer 1 (Stratec Molecular) is placed on the spin filter, followed by centrifugation at 10,000 g for 1 min. Then dry centrifugation is performed at 10,000 g for 5 min. 100 μl elution buffer (Stratec Molecular) is placed on the spin filter, followed by centrifugation at 10,000 g for 1 min. The throughput "eluate" contains the pure DNA.

Figure 8:
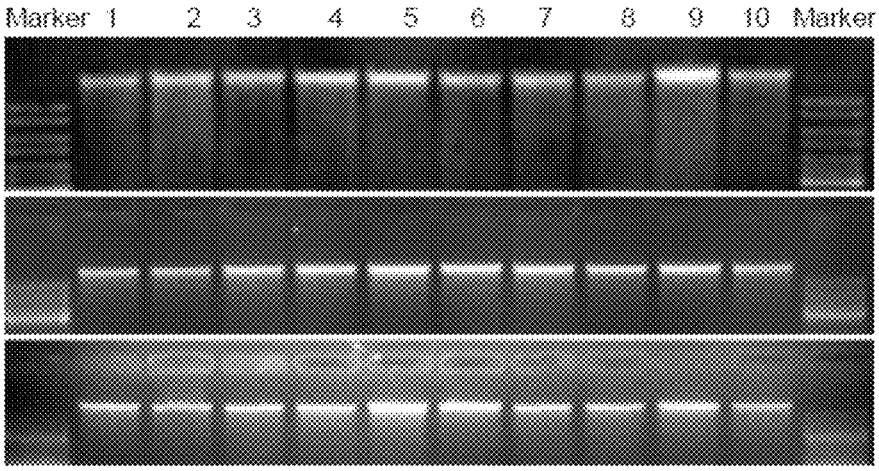
FIG. 8 shows gel analysis of specimens after 1, 3 and 6 months of storage.

FIG. 8 shows a gel analysis of specimens after 0, 3 and 6 months of storage. Isolated DNA was stored at room temperature. The following specimens were applied to 0.8% agarose gel: 10 specimens, 10 μl specimen and 4 μl Gene Ruler DNA Ladder Mix (first and last lanes), Fermentas. The DNA is not decomposed and shows a clean, distinct band. Even after a long period of stabilization, storage and conservation, the DNA is stable and exhibits no loss of integrity. The specimens were stabilized with the aid of the preferred system, the stabilization buffer being present in the test tube in a freeze-dried state or as a liquid buffer and the viscous bodily fluid containing the nucleic acid being introduced into the tube via a funnel and the funnel is subsequently discarded. The tube was closed with a closing element.

What we claim is:

1. System for stabilizing, conserving and storing of a nucleic acid, comprising:

a test tube having a body and an opening which is closed with a first closing element to create an interior within the body of the test tube and wherein said interior is sterile, wherein the first closing element has a first diameter, a stabilization mixture within the interior of the test tube and comprising ammonium chloride and/or polyvinylpyrrolidone, a denaturant, a chelator and a buffer for stabilizing, conserving and storing said nucleic acid, a funnel comprising an open conical element and a tube element, wherein the tube element is adapted to fit to the opening of the test tube, and a second closing element, wherein the second closing element is adapted to sealably fit the opening of the test tube, wherein the second closing element has a second diameter and wherein the first diameter and second diameter are the same wherein the stabilization mixture comprises polyvinylpyrrolidone and CTAB as a denaturant.

2. System of claim 1, wherein the stabilization mixture is freeze-dried.

3. System of claim 2, wherein the stabilization mixture is a substance that dissolves in a viscous bodily fluid containing the nucleic acid.

4. System of claim 3, wherein the nucleic acid comprises DNA.

5. System of claim 3, wherein the bodily fluid is blood plasma, chyle, lymph, urine, sperm, vaginal secretion, amniotic fluid, sputum, gastric juice, bile, pancreatic juice, nasal secretion, bronchial secretion, alveolar fluid, liquor, endolymph, aqueous humor, lacrimal fluid, synovial fluid, pleural fluid, pericardial fluid (liquor pericardii), peritoneal fluid, mother's milk, sweat, menstruation fluid or a combination thereof.

6. System of claim 1, wherein the stabilization mixture is a liquid.

7. System of claim 1, wherein the denaturant is cetyltrimethylammonium bromide (CTAB), the chelator is ethylenediamine-tetraacetic acid (EDTA) and the buffer is tris (hydroxymethyl) aminomethane (TRIS).

8. System of claim 7, wherein the CTAB is present in a concentration of 1-4%.

9. System of claim 7, wherein the EDTA is present in a concentration of 0.05-1%.

10. System of claim 7, wherein the TRIS is present in a concentration of 0.05-1%.

11. System of claim 1, wherein the stabilization mixture comprises ammonium chloride.

12. System of claim 11, wherein the ammonium chloride is present in a concentration of 15-25%.

13. System of claim 1, wherein the stabilization mixture comprises polyvinylpyrrolidone in a concentration of 1-4%.

14. System of claim 1, wherein the stabilization mixture comprises a reducing agent, an antiviral and/or an antimicrobial agent.

15. System of claim 1, wherein at least said first closing element is a closing element that can be removed from the test tube or is made of a material that is pierceable via the tube element of the funnel.

16. The system of claim 1, wherein the test tube is a standard test tube holding a volume of 1 to 20 ml.

17. Kit for stabilizing, conserving and storing nucleic acids, comprising a system according to claim 1, and, optionally, in a separate container, instructions of how to use components of the system.

18. The system of claim 1, wherein the stabilization mixture comprises polyvinylpyrrolidone in a concentration of 1-4% and CTAB, in a concentration of 1-4%, as a denaturant.

19. The system of claim 1, wherein the stabilization mixture comprises polyvinylpyrrolidone, ammonium chloride and CTAB as a denaturant.

20. The system of claim 1, wherein the stabilization mixture consisting ammonium chloride, polyvinylpyrrolidone, a denaturant, a chelator and a buffer for stabilizing, conserving and storing said nucleic acid.

* * * * *